US007128280B1

(12) United States Patent
Boecking

(10) Patent No.: US 7,128,280 B1
(45) Date of Patent: Oct. 31, 2006

(54) INJECTION NOZZLE FOR INTERNAL COMBUSTION ENGINES, WHICH HAS AN ANNULAR GROOVE IN THE NOZZLE NEEDLE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 851 days.

(21) Appl. No.: 09/831,025

(22) PCT Filed: Aug. 18, 2000

(86) PCT No.: PCT/DE00/02814

§ 371 (c)(1),
(2), (4) Date: Dec. 11, 2001

(87) PCT Pub. No.: WO01/18387

PCT Pub. Date: Mar. 15, 2001

(30) Foreign Application Priority Data

Sep. 4, 1999 (DE) ..... 199 42 370

(51) Int. Cl.
*F02M 61/00* (2006.01)

(52) U.S. Cl. ..... 239/533.12; 239/533.8; 239/533.9; 239/854

(58) Field of Classification Search ..... 239/533.3, 239/533.8, 533.9, 533.12, 584; 123/446, 123/496, 299, 304
See application file for complete search history.

(56) References Cited

U.S. PATENT DOCUMENTS

| | | | | |
|---|---|---|---|---|
| 1,952,816 | A * | 3/1934 | Mock | 239/533.12 |
| 2,927,737 | A * | 3/1960 | Werner et al. | 239/533.3 |
| 4,153,205 | A * | 5/1979 | Parrish, Jr. | 239/533.9 |
| 4,470,548 | A * | 9/1984 | Ushimura | 239/533.3 |
| 5,199,398 | A * | 4/1993 | Nylund | 123/299 |
| 5,588,412 | A * | 12/1996 | Nozaki | 123/496 |
| 5,725,157 | A * | 3/1998 | DeLuca | 239/533.9 |
| 5,743,470 | A * | 4/1998 | Schlaf et al. | 239/533.9 |
| 5,890,660 | A * | 4/1999 | Stevens | 239/533.3 |
| 6,257,506 | B1 * | 7/2001 | Hofmann et al. | 239/533.9 |
| 6,565,017 | B1 * | 5/2003 | Fath et al. | 239/533.3 |
| 6,669,117 | B1 * | 12/2003 | Boecking | 239/533.3 |

FOREIGN PATENT DOCUMENTS

EP 0283154 A1 * 9/1988

* cited by examiner

*Primary Examiner*—Steven J. Ganey
(74) *Attorney, Agent, or Firm*—Ronald E. Greigg

(57) ABSTRACT

An injection nozzle is proposed in which the nozzle needle has an annular groove in the vicinity of the transition between the blind hole and the nozzle needle seat. In seat hole injection nozzles, the annular groove is disposed in the vicinity of the injection orifice(s). The annular groove reduces the tolerance of the flow resistance of the injection nozzle with a partial stroke of the nozzle needle and thus permits a more precise measurement of the fuel quantity injected.

1 Claim, 2 Drawing Sheets

INJECTION NOZZLE FOR INTERNAL COMBUSTION ENGINES, WHICH HAS AN ANNULAR GROOVE IN THE NOZZLE NEEDLE

CROSS-REFERENCE TO RELATED APPLICATIONS

This application is a 35 USC application of PCT/DE 00/02814 filed on Aug. 18, 2000.

BACKGROUND OF THE INVENTION

1. Field of the Invention

The invention is based on an injection nozzle for internal combustion engines, which has at least one injection orifice, a nozzle needle seat, and a nozzle needle.

2. Description of the Prior Art

Injection nozzles of this generic type, primarily in the partial stroke range of the nozzle needle, have a large variation in the flow resistance and therefore also of the fuel quantity injected. As a result of this, the emission and consumption behavior of many internal combustion engines equipped with these injection nozzles is not optimal.

OBJECTS AND ADVANTAGES OF THE INVENTION

The object of the invention is to produce an injection nozzle in which the variation in the injection quantity in the partial stroke range of the nozzle needle is reduced in various specimens of an injection nozzle of the same design and consequently, the consumption and emission behavior of internal combustion engines equipped with the injection nozzles according to the invention is improved.

This object is attained by means of an injection nozzle for internal combustion engines which has at least one injection orifice, a nozzle needle seat, and a nozzle needle, wherein the end of the nozzle needle oriented toward the nozzle needle seat has an annular groove.

In the partial stroke range of the nozzle needle, the annular groove in the end of the nozzle needle oriented toward the nozzle needle seat is decisive for the throttle action of the injection nozzle. Since it is possible to manufacture annular grooves with high precision reproducibility, there is thus very little variation in the throttle action of the injection nozzle between specimens of an injection nozzle of the same design. For this reason, by measuring the operating behavior of an injection nozzle according to the invention, the operating behavior of all other injection nozzles of the same design can be predicted with significantly greater precision and the control of the injection process can be correspondingly optimized.

A variant of an injection nozzle according to the invention provides that the nozzle needle seat is the shape of a truncated cone, which results in a favorable sealing action and a favorable centering of the nozzle needle in the nozzle needle seat.

In another embodiment of the invention, the cone angle of the nozzle needle seat is approximately 60° so that a favorable sealing action is produced between the nozzle needle and the nozzle needle seat.

In a modification of the invention, the end of the nozzle needle oriented toward the nozzle needle seat is a cone and the cone angle of the nozzle needle is up to one degree greater than, preferably 15–30 angular minutes greater than, the cone angle of the nozzle needle seat so that the sealing surface is reduced and is shifted into the vicinity of the greatest diameter of the nozzle needle.

In one embodiment of the invention, the annular groove runs parallel to the base surface of the cone so that the same flow conditions prevail over the entire circumference of the nozzle needle.

One variant provides that a blind hole adjoins the nozzle needle seat and has at least one injection orifice so that the advantages of the nozzle needle according to the invention can also be used in blind hole injection nozzles.

One embodiment of the invention provides that when the injection nozzle is closed, the distance of the transition between the blind hole and the nozzle seat from the bottom of the injection nozzle and the distance of the annular groove from the bottom of the injection nozzle are essentially equal so that in the partial stroke range of the nozzle needle, the throttle action of the injection nozzle is defined by the annular groove instead of the transition.

One embodiment of the invention provides that the width of the annular groove is 0.1 mm to 0.3 mm, preferably 0.16 mm to 0.24 mm, so that the annular groove is decisive for the throttle action of the injection nozzle over a sufficiently large partial stroke range. In any case, the annular groove must be large enough that only the leading edge of the annular groove throttles momentarily.

Another embodiment of the invention provides that the depth of the annular groove is 0.02 mm to 0.2 mm, preferably 0.08 mm to 0.14 mm, so that the volume of the annular groove remains low and consequently, so does the quantity of fuel that evaporates when the internal combustion engine is switched off. Nevertheless, the annular groove exerts a sufficient influence on the throttle action of the injection nozzle.

In another embodiment of the invention, the blind hole is conical so that the partial load behavior of conical blind hole injection nozzles is improved.

One modification of the invention provides that the blind hole is embodied as cylindrical so that the partial load behavior of cylindrical blind hole injection nozzles is also improved.

Another embodiment provides that the blind hole is a mini-blind hole or micro-blind hole so that the advantages according to the invention can be used in these injection nozzles as well.

One variant according to the invention provides that the nozzle needle seat has at least one injection orifice so that the advantages of the nozzle needle according to the invention can also be used in seat hole injection nozzles. In seat hole injection nozzles, there is also occasionally the problem that due to insufficient centering of the nozzle needle in relation to the nozzle needle seat, the pressure of the fuel prevailing in the injection orifices distributed over the circumference is unequal, which can lead to unfavorable conditions in the injection. The annular groove can produce a pressure balancing between the injection orifices so that the insufficient centering of the nozzle needle does not have a negative impact on the injection conditions.

Another variant provides that when the injection nozzle is closed, the distance of the piercing point of the longitudinal axis of the injection orifice(s) through the nozzle needle seat from the bottom of the injection nozzle and the distance of the annular groove from the bottom of the injection nozzle are essentially equal so that in the partial stroke range of the nozzle needle, the throttle action of the injection nozzle is defined by the annular groove instead of the transition from the nozzle needle seat into the injection orifice.

In one embodiment of the invention, the width of the annular groove is greater than, preferably one-and-a-half times greater than, the diameter of the injection orifice(s) so that the throttle action of the injection nozzle is influenced by the annular groove over a sufficiently large partial stroke range.

Other embodiments of the invention provide that the depth of the annular groove is less than the width of the annular groove or that the depth of the annular groove is 0.02 mm to 0.1 mm, preferably 0.04 mm to 0.07 mm, so that the volume of the annular groove remains low, but the annular groove nevertheless exerts a sufficient influence on the throttle action of the injection nozzle.

BRIEF DESCRIPTION OF THE DRAWINGS

Other advantages and features of the invention will be apparent from the following description, taken with the drawings, in which.

DESCRIPTION OF THE PREFERRED EMBODIMENTS

Figure 1:
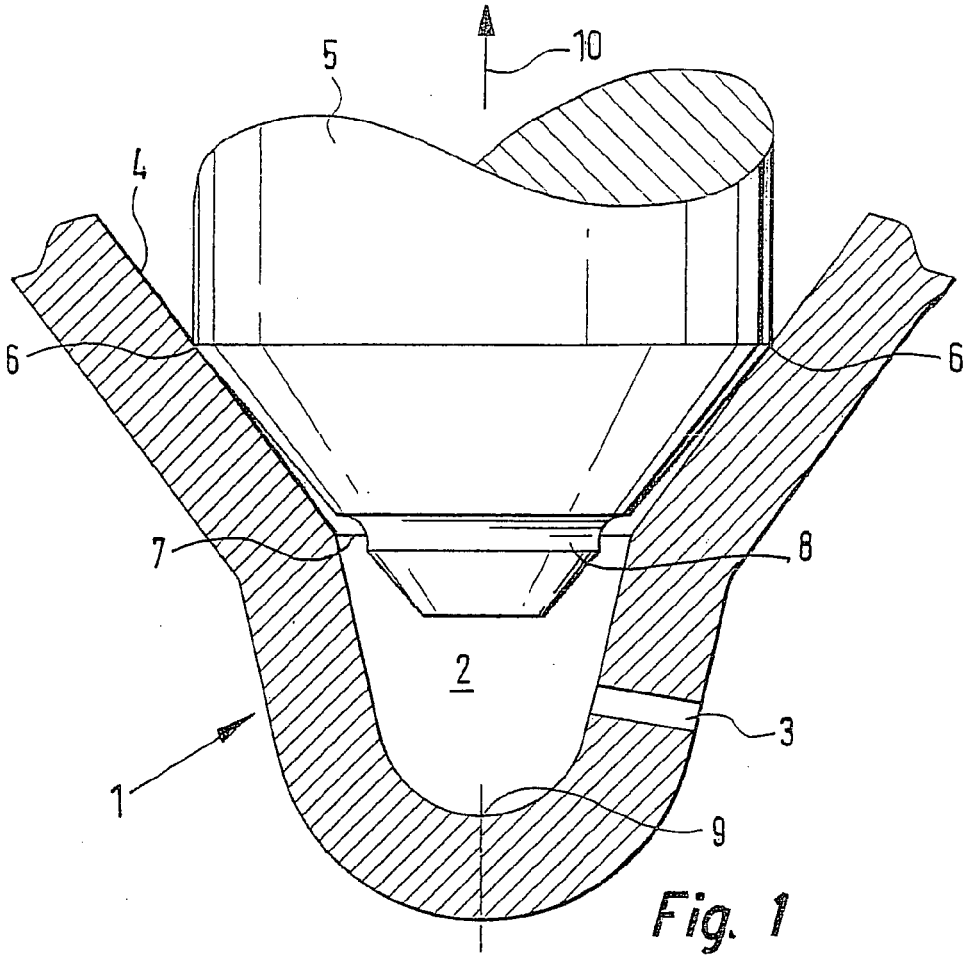
FIG. 1 shows a cross section through a blind hole injection nozzle according to the invention.

FIG. 1 shows an injection nozzle 1 with a conical blind hole 2. The blind hole 2 can also be cylindrical or can be a mini- or micro-blind hole 2. In the latter, the volume of the blind hole 2 is reduced in comparison to that of the design shown in FIG. 1. As a result, less fuel evaporates into the combustion chamber when the internal combustion engine is switched off.

The fuel, not shown, travels out of the blind hole 2 via an injection orifice 3 and into the combustion chamber, likewise not shown. The conical blind hole 2 is adjoined by a nozzle needle seat 4 that is the shape of a truncated cone. The nozzle needle seat 4 can have a cone angle of 60°.

A nozzle needle 5 rests against the nozzle needle seat 4. FIG. 1 clearly shows that the cone angle of the nozzle needle 5 is greater than the cone angle of the nozzle needle seat 4. As a result, the contact zone 6 between the nozzle needle 5 and the nozzle needle seat 4 is disposed in the vicinity of the greatest diameter of the nozzle needle 5 and the surface pressure between the nozzle needle 5 and the nozzle needle seat 4 is increased. The difference between the cone angles of the nozzle needle 5 and the nozzle needle seat 4 is shown in exaggerated fashion in FIG. 1. As a rule, the above-mentioned difference is less than 1 degree and ranges in the vicinity of a few angular minutes.

The transition between the blind hole 2 and the nozzle needle seat 4 according to the prior art is an edge 7 which is produced during the grinding of the nozzle needle seat 4. Depending on the type of machining, the edge 7 can be a sharp burr or a smooth edge. The flow resistance of the edge 7 is significantly influenced by the quality of this edge.

An annular groove 8 that is cut or ground into the nozzle needle 5 reduces the influence of the edge 7 on the flow resistance of the injection nozzle 1. The distance of the annular groove 8 from a bottom 9 of the injection nozzle 1 is approximately the same as the distance of the bottom 9 of the injection nozzle 1 from the edge 7. As a result, independent of the stroke of the nozzle needle 5, the throttle action of the injection nozzle 1 is not influenced by the geometry of the edge 7 or is only influenced to an insignificant degree by it. This effect is based on the fact that because of the hydraulic diameter of the annular gap between the annular groove 8 and the edge 7—which hydraulic diameter is large in comparison to the annular gap between the nozzle needle seat 4 and the cone of the nozzle needle 5, the flow resistance in the latter annular gap is less than the flow resistance in the former annular gap. Since the two flow resistances are connected in series, essentially the smallest individual resistance is decisive for the flow resistance of the entire injection nozzle.

Figure 2:
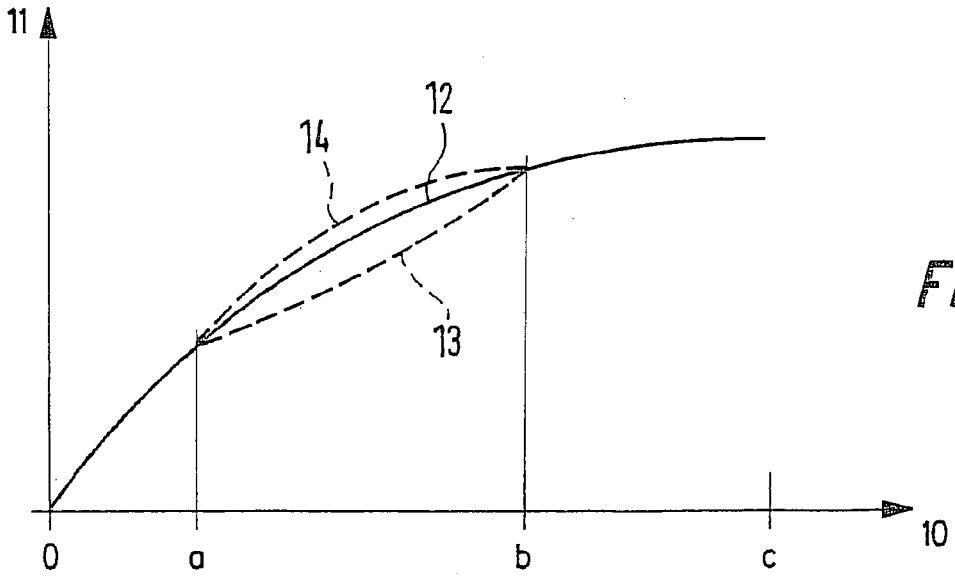
FIG. 2 shows a characteristic curve of the hydraulic diameter of a blind hole injection nozzle according to the invention over the stroke of the nozzle needle.

The sequences of the variation of the flow resistance of injection nozzles 1 in the vicinity of the edge 7 are depicted in the graph shown in FIG. 2. In FIG. 2, the hydraulic diameter 11 of a blind hole injection nozzle 1 is qualitatively plotted over the nozzle needle stroke 10. The hydraulic diameter 11 is a value by means of which arbitrary cross sections that are flowed through can be made comparable with regard to their flow resistance. The flow resistance of a tube with a circular cross section is used as a reference value. A cross section with a large hydraulic diameter has a low flow resistance and vice versa.

In FIG. 2, the nozzle needle stroke 10 has been divided into two ranges. A first range extends from zero to "a"; the second range, which will be referred to below as the partial stroke range, extends from "a" to "b". The full nozzle needle stroke is reached at "c".

When a closed injection nozzle 1, in which the nozzle needle 5 rests against the nozzle needle seat 4, is opened, with a very small nozzle needle stroke 10, a very narrow gap is produced in the vicinity of the contact zone 6, as a result of which the pressurized fuel can flow into the blind hole 2. This very narrow gap decisively determines the flow resistance of the injection nozzle 1 and therefore also determines the hydraulic diameter 11. Since the flow resistance of this very narrow gap is high, the hydraulic diameter 11 of the injection nozzle 1 is very small with a very small nozzle needle stroke 10.

In the partial stroke range between "a" and "b", the flow resistance of injection nozzles 1 according to the prior art is decisively determined by the edge 7 between the nozzle needle seat 4 and the blind hole 2. Consequently, in the partial stroke range, the edge 7 is also highly significant for the hydraulic diameter of the injection nozzle 1. This means that changes in the geometry of the edge 7 result in changes to the hydraulic diameter 11. In the vicinity of the full nozzle needle stroke "c", the injection orifice 3 of the injection nozzle 1 is decisive for the hydraulic diameter of the injection nozzle 1.

In accordance with the above, variations in the geometry of the edge 7 lead to a change in the characteristic curve 12 of the injection nozzle 1 primarily in the partial stroke range between "a" and "b".

FIG. 2 shows characteristic curves 12 and 13 of an injection nozzle 1 according to the prior art and a characteristic curve 14 of a blind hole injection nozzle 1 according to the invention. With the injection nozzle 1 according to the prior art, the nozzle needle 5 has no annular groove. Because of the above-described variations in the geometry of the edge 7, the characteristic curves of different specimens of injection nozzles 1 of the same design also vary, particularly in the partial stroke range. This is shown in FIG. 2 by the deviations of the characteristic curves 12 and 13 from each other.

The characteristic curve 14 represents an injection nozzle according to the invention in which the edge 7 does not influence the throttle action, primarily in the partial stroke range, since the fuel can be diverted into the annular groove 8. As a result, the hydraulic diameter 11 of the injection nozzle 1 according to the invention is greater in the partial stroke range than that of injection nozzles 1 according to the prior art. Primarily, however, the characteristic curves 14 of different specimens of injection nozzles 1 with the same design according to the invention vary much less, particularly in the partial stroke range, since the geometry of the annular groove 8 can be manufactured with higher precision reproducibility.

In mass-produced internal combustion engines, the program map of the engine and the associated injection system is determined by measuring one or more selected test specimens. The program maps that are determined in this manner form the basis underlying all injection systems of the same design.

It will be assumed below that the characteristic curve 12 is a measured characteristic curve and that this characteristic curve 12 is stored in the control unit of the injection system. It is also assumed that an injection nozzle 1 selected from the mass production has the characteristic curve 13. If the injection nozzle 1 with the characteristic curve 13 cooperates with a control unit in which the characteristic curve 12 is stored, then the actual injection quantity in the partial stroke range of the injection nozzle 1 with the characteristic curve 13 does not coincide with the optimal injection quantity according to the characteristic curve 12 measured in the test specimens so that the power and/or emission behavior of the internal combustion engine is impaired.

With the injection nozzles 1 according to the invention, the characteristic curves 14 vary to only an extremely slight degree so that in all internal combustion engines equipped with injection nozzles 1 according to the invention, the correspondence between the characteristic curve 14 stored in the control unit and the characteristic curves 14 of the installed injection nozzles 1 is significantly improved. In comparison to the variation in injection nozzles 1 according to the prior art, the correspondence can, for example, be improved by a factor of 2 to 3. As a result of this, the fuel quantity actually injected corresponds precisely with the injection quantity preset by the control unit and the consumption and emission behavior of the internal combustion engine is optimal.

Figure 3:
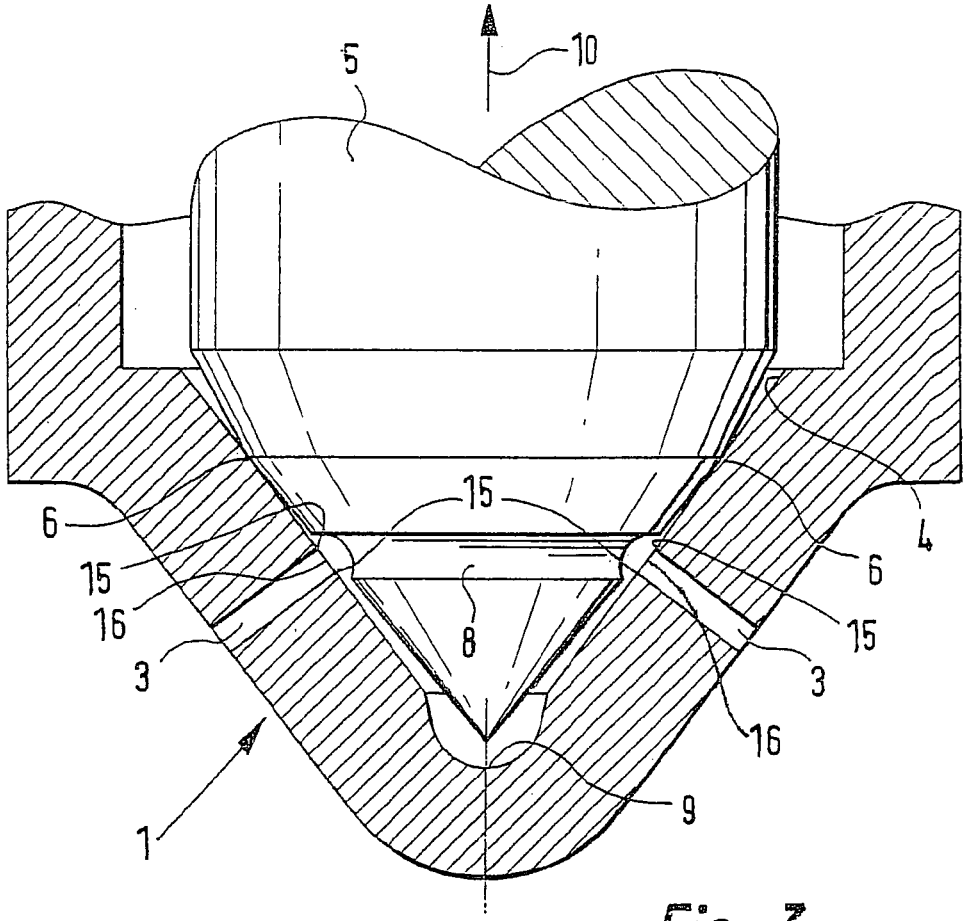
FIG. 3 shows a cross section through a seat hole injection nozzle according to the invention and FIG. 4 shows a characteristic curve of the hydraulic diameter of a seat hole injection nozzle according to the invention over the stroke of the nozzle needle.

FIG. 3 shows an injection nozzle 1 according to the invention, with injection orifices 3 embodied as seat holes. The reference numerals correspond to the related numerals in FIG. 1. The essential difference lies in that in the partial stroke range, instead of the edge 7, the transition 15 between the nozzle needle seat 4 and the injection orifices 3 is decisive for the flow resistance of the injection nozzle 1. In seat hole injection nozzles, the annular groove 8 according to the invention is disposed at the level of the injection orifices 3 so that the influence of the transition 15 between the nozzle needle seat 4 and the injection orifices 3 on the flow resistance of the injection nozzle is sharply reduced. The distance of the annular groove 8 from the bottom 9 of the injection nozzle 1 is approximately equal to the distance between the bottom 9 of the injection nozzle 1 and a piercing point 16 of the longitudinal axis of the injection orifice 3 through the nozzle needle seat 4. As a result, independent of the stroke of the nozzle needle 5, the throttle action of the injection nozzle 1 is not influenced by the geometry of the transition 15 or is only influenced to an insignificant degree by it.

Figure 4:
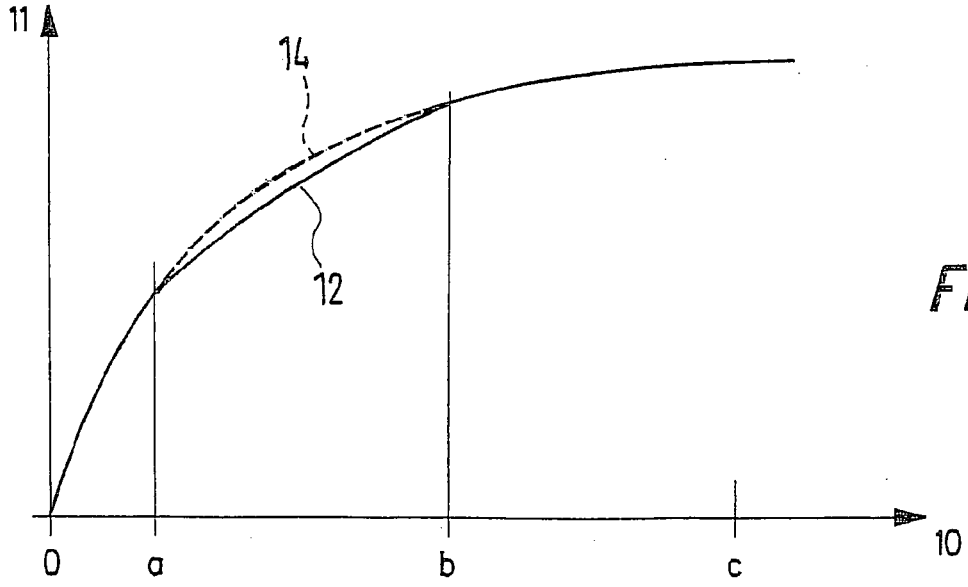

FIG. 4 shows the characteristic curve 12 of an injection nozzle 1 according to the prior art and the characteristic curve 14 of a seat hole injection nozzle 1 according to the invention.

That which is mentioned above in relation to blind hole injection nozzles also applies correspondingly to the seat hole injection nozzles according to the invention, with the differences mentioned.

The foregoing relates to preferred exemplary embodiments of the invention, it being understood that other embodiments and variants thereof are possible within the spirit and scope of the invention, the latter being defined by the appended claims.

I claim:

1. In an injection nozzle (1) for internal combustion engines, which has at least one injection orifice (3), a nozzle needle seat (4), and a nozzle needle (5), the improvement wherein the end of the nozzle needle (5) oriented toward the nozzle needle seat (4) is a cone and has an annular groove (8), wherein a blind hole (2) adjoins the nozzle needle seat (4) and has the at least one injection orifice (3), and wherein the blind hole (2) is conical wherein when the injection nozzle (1) is closed, the distance of the transition (7) between the blind hole (2) and the nozzle seat (4) from the bottom (9) of the injection nozzle (1) and the distance of the annular groove (8) from the bottom (9) of the injection nozzle (1) are essentially equal, and wherein the width of the annular groove (8) is approximately 0.1 mm to 0.3 mm.

* * * * *